United States Patent [19]

Rom et al.

[11] 4,266,609

[45] May 12, 1981

[54] METHOD OF EXTRACTING LIQUID AND GASEOUS FUEL FROM OIL SHALE AND TAR SAND

[75] Inventors: Josef Rom, Haifa, Israel; Israel Alterman, 7 Habrosh St., Savion, Israel, 56915; Josef Shwartz, Haifa, Israel

[73] Assignees: Technion Research & Development Foundation Ltd., Haifa; Isreal Alterman, Savion, both of Israel

[21] Appl. No.: 48,733

[22] Filed: Jun. 15, 1979

[30] Foreign Application Priority Data

Nov. 30, 1978 [IL] Israel ..... 56088

[51] Int. Cl.[3] ..... E21B 43/24; E21B 43/247; E21B 47/06; E21B 36/04

[52] U.S. Cl. ..... 166/251; 166/57; 166/65 R; 166/257; 166/259

[58] Field of Search ..... 166/248, 251, 256, 257, 166/259, 281, 302, 57, 60, 65 R; 175/11, 16, 17

[56] References Cited

U.S. PATENT DOCUMENTS

| | | | |
|---|---|---|---|
| 3,346,048 | 10/1977 | Strange et al. | 166/281 X |
| 3,411,575 | 11/1968 | Connally, Jr. | 166/259 |
| 3,493,060 | 2/1970 | Van Dyk | 175/16 |
| 3,693,718 | 9/1972 | Stout | 166/302 |
| 3,977,478 | 8/1976 | Shuck | 175/16 |
| 4,019,331 | 4/1977 | Rom et al. | 299/11 X |
| 4,061,190 | 12/1977 | Bloomfield | 166/259 |
| 4,090,572 | 5/1978 | Welch | 175/16 |
| 4,113,036 | 9/1978 | Stout | 166/248 |

*Primary Examiner*—James A. Leppink
*Assistant Examiner*—George A. Suchfield
*Attorney, Agent, or Firm*—Browdy & Neimark

[57] ABSTRACT

Kerogen and other combustible matter can be extracted from an area of oil shale or tarsand by drilling boreholes in a selected pattern through the overlying soil and rock without removing it. Each borehole mouth is tightly closed by a cover provided with an air inlet pipe and a gas exhaust pipe. In the covers of one or several boreholes, the inlet pipe is centrally guided and longitudinally movable in an upward and downward direction, and a laser beam generated by a laser source is inroduced into the upper end of the pipe and directed centrally to its bottom where it is diverted toward the borehole wall by a mirror assembly. The laser beam moved along the borehole wall irradiates the oil shale or tarsand and ignites the combustible matter contained therein which liquefies and evaporates. Combustion spreads from the initially ignited bore to the remaining bores in the area through the fissures in the formation and likewise serves to liquefy and evaporate the kerogen there. The combustion is maintained by pressurized air or oxygen introduced through the air inlet pipe, which also serves to cool the mirror assembly. The pressure thus created drives the evaporated kerogen out of the borehold through the exhaust pipe into a storage vessel. After the output has become too low, the process is discontinued and liquefied kerogen which has gathered at the bottom of the bores is pumped out or floated to the surface.

14 Claims, 2 Drawing Figures

METHOD OF EXTRACTING LIQUID AND GASEOUS FUEL FROM OIL SHALE AND TAR SAND

Figure 1:
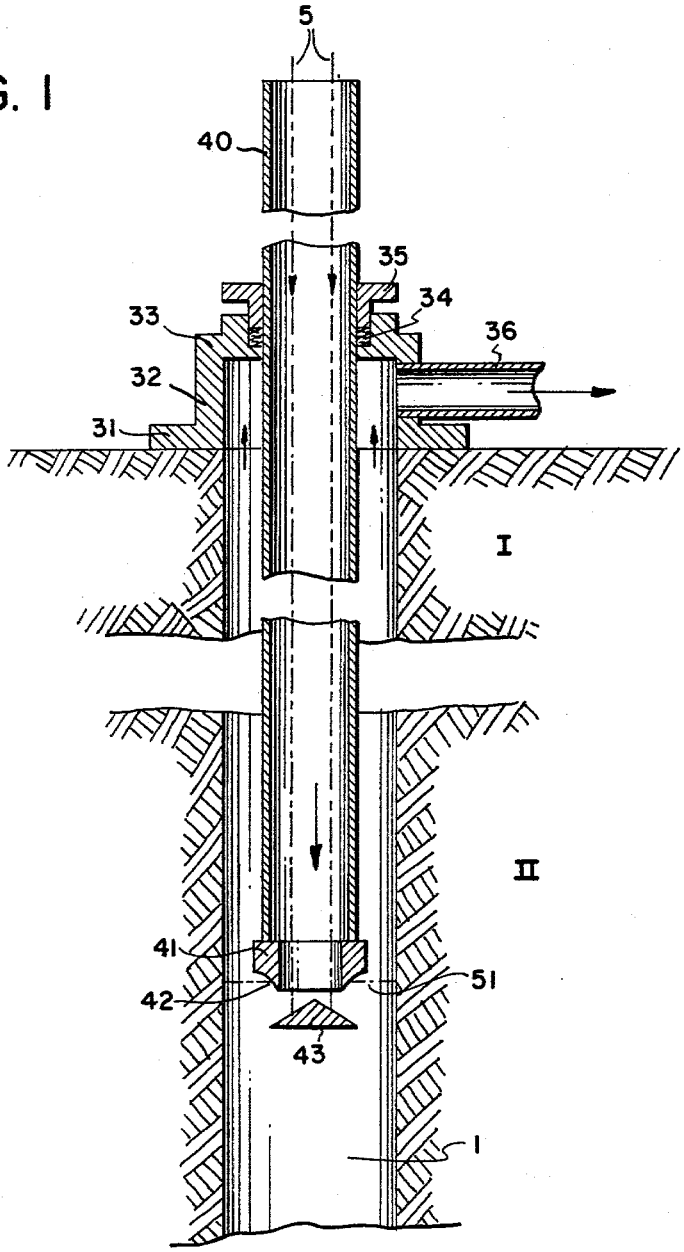

The invention relates to a method of obtaining gaseous and liquid fuel from kerogens and other organic matter contained in oil shale or tar-sand, by means of controlled heating, liquification and by evaporation of a portion of the kerogen and other organic matter.

With diminishing oil reserves and the steadily-increasing fuel prices, as a consequence, the world has lately been searching for new energy sources and for new ways of exploiting both old and new sources. In the course of these endeavours it has been proposed to extract kerogens from underground reservoirs of shale, bituminous limestone, etc., and efforts to that effect have been made. All these minerals will henceforth be referred to as "oil shale", and any statement with regard to oil shale, or shale for short, shall be construed to refer to the other minerals as well, unless one or more of them is expressly excluded. Oil shale contains organic matter which yields oil and gases when heated to a temperature of between 300° and 700° C., and different methods have been developed for this purpose; high production costs, however, are deterring would-be exploiters from regular production.

One of these methods comprises mining the oil-bearing rock, breaking it up to gravel and smaller size and extracting the fuel in gas form by heating the comminuted material in distillation vessels. The kerogen is then collected in storage vessels for further refining. With a view to saving fuel, the heat obtained from any gas burnt is used for preheating the combustion air, but this does not appreciably reduce production costs since these arise mostly from the handling of enormous masses of rock necessary to obtain the small percentage of oil contained therein. A rough calculation shows that about 80 tons of rock have to be moved for every ton of kerogen produced.

Another known method comprises the removal of the layer of rock and soil overlying the oil-bearing shale, and drilling a large number of boreholes through the shale down to bedrock. To loosen the rock structure explosive charges are detonated inside these bores. The upper shale layer is then ignited and a top layer of about one third of the total thickness of the shale is left to burn for a time sufficient to heat the entire layer of the oil shale to the desired temperature. This causes that portion of kerogen which has not evaporated to percolate to the bottom of the boreholes where it accumulates. In order to gather the kerogen thus collected large number of tunnels are drilled above bedrock which serve to concentrate the oil and to transport it to the surface. The major expense factor in this method is the preparation of the tunnels as well as the removal of the—sometimes very thick—layer of rock and soil above the shale.

It is, therefore, the object of the present invention to obtain kerogen and other combustible matter from oil bearing shale or tar-sand or bituminous without the need for removing the overlying rock and soil. Another object is to evaporate the kerogen in situ and to collect the vapours above ground, to be subsequently condensed and refined, while the non-condensible components can be used as gaseous fuel. Yet another object is to extract the considerable amounts of sulphur contained in the shale, tar-sands or bituminous lime stone.

The method of extracting kerogen from oil shale, according to the invention, comprises the following steps in combination, drilling at least one substantially perpendicular borehole from above, through the overlying soil and rock, into and through the shale layer;

detonating an explosive charge inside the borehole, in order to loosen the rock structure, and to increase its permeability;

closing the mouth of said borehole by means of a tight cover provided with first duct means connected to a gas or air compressor, with second duct means connected to at least one gas storage vessel, and with third duct means (which may be the same duct as the first duct means) adapted to permitting a laser beam to be directed into the borehole;

guiding said laser beam by optical lens and or mirror systems through said third duct means into the borehole and irradiating the walls of the borehole for at least part of its path through the oil shale layer, thereby causing the combustible matter in the shale to be ignited;

pumping air or oxygen into the borehole through said first duct means in a quantity sufficient both to keep the combustion going and to cool the laser beam guide equipment;

receiving combustion gases, evaporated kerogen and other vapours, including sulphur, through said second duct means in the cover and collecting them in said gas storage vessel.

In this manner an area of oilshale of the required size is covered by a number of boreholes separated by predetermined intervals and arranged either concentrically or in a rectangular pattern. Each hole is provided with a cover in the manner described and the gas ducts in the said covers are preferably permanently connected to a manifold of pipes leading respectively to an air compressor and to gas and/or liquid storage and separating vessels. Laser radiation equipment is mobile for igniting one borehole after the other.

The amount of air pumped into the borehole as well as the radiation intensity can be controlled as indicated by measuring the temperature of the produced gas or measuring the properties and the quantity of the extracted gases as well as the temperature inside the borehole i.e. with increasing temperature less air is introduced, and the laser intensity can be reduced until it can be removed altogether in preparation for its transfer to a neighboring borehole; combustion is maintained by the stored heat and the continuing combustion air supply.

After a certain time, when tests show that the contents of kerogen and gas in the obtained products has become too small for economic working, the combustion process is stopped by turning off the air or oxygen supply; this causes the kerogen still contained in the shale to liquefy and to flow to the bottom of the boreholes. From there it can be raised by pumping or by flooding the entire area with water on which the oil will float to the surface, where it can be collected.

The laser radiation beam guiding equipment is preferably combined with an air pipe leading concentrically into the borehole through the first duct means. This pipe is movable in an upward and a downward direction, the laser beam being introduced into it above ground and guided along its centre axis to a mirror assembly arranged below its bottom opening, where it serves to direct the beam into the shale surrounding the borehole. Air or oxygen is pumped through this pipe in order to cool the mirror assembly and also to serve as combustion air. In addition it creates pressure in the borehole which helps to expel the vaporized kerogen and other gases into the storage vessel provided. The laser radiation and guiding equipment is similar to that illustrated and described in U.S. Pat. No. 4,019,331 in conjunction with the method for the formation of foundations by laser-beam irradiation of the soil, it being most closely similar to the equipment shown in FIG. 4 of the drawings of the above specification.

In many regions the groundwater table lies above the lower horizon of the kerogen-rich shale, which makes it necessary to remove the water before the ignition process can be started. This is done by means of submersible pumps or borehole pumps reaching to the bottom of one or several of the boreholes and serving to lower the water level to the desired depth. It may be necessary to continue pumping while the kerogen-extracting process is under way in order to prevent the water level from rising again; this is carried out by operating a pump in some of the boreholes over a larger area, wherein the water gathers by flowing through the underground fissures and cracks. As soon as the rock mass is heated to high temperatures, the water present will turn into steam, which can be utilized by known means.

A secondary feature of the presence of water is the dissociation of water vapour into hydrogen and oxygen under the influence of the heat of the laser beam. The freed oxygen assists the combustion process, while the hydrogen serves to assist in the cracking process of the high-temperature kerogen vapour.

However, in all cases where the entire shale layer is wet due to high groundwater level, it is necessary to dry the shale in situ before starting its ignition by laser beam equipment, and this process can be carried out by using conventional heating means and equipment, such as electric heaters, oxyacetylene flames, or the like.

A closely similar method can be employed for extracting kerogen from tar sands; owing to the loose sand formation there is no need for "loosening up" by the detonation of explosives but, on the other hand, stabilization of the borehole walls may be required. This can be achieved by a number of known methods. A simple process comprises drilling the holes while adding a solution of lime in water. The solution should just suffice to bind the sand particles together, but should not be concentrated enough to fill the voids between them. Again, as with oil shale the tar sand region to be exploited is drilled by placing boreholes in a suitable distribution, pumping water out of the area whenever necessary and igniting a portion of the boreholes. Combustion spreads through the loose sand between neighbouring bores, and gas and vapour are extracted by means of equipment similar to the aforedescribed.

It has been proposed, as described in U.S. Pat. No. 4,113,036 (Daniel W. Stout) to drill a vertical borehole in a rock formation containing fossil fuel deposits, to project a laser beam into this borehole and to deflect it angularly at the desired depth in order to drill a pattern of bore passages laterally directed to the axis of the borehole. The object of that invention is to inject fluids into the passages so drilled with a view to obtaining in-situ fractionation of the fuel deposits. In contradistinction to the above invention which employs a solid, unidirectional laser beam which can penetrate deeply into the rock formation, the present method comprises the circumferential irradiation of the borehole wall surface, with the object of heating the organic matter contained therein and igniting it. The method further comprises means for maintaining combustion by introducing air or oxygen into the borehole and to remove the gasified fuel through the borehole top and to convey it to storage containers. Whilst according to the patent cited the horizontal bores are drilled to loosen the rock formation, the loosening according to the present invention is accomplished by detonating an explosive charge inside the borehole or boreholes. The method according to the above patent requires high-power, and accordingly expensive, equipment, which not only consumes considerable electric power, but also demands a large quantity of cooling fluid, while for irradiating the borehole walls relatively low-power laser generating plant will be required. A further advantage of the present, as compared with the above, invention, is the use of the combustion air for cooling the mirrors and for providing the pressure necessary for expelling the gasified fuel out of the borehole.

Figure 2:
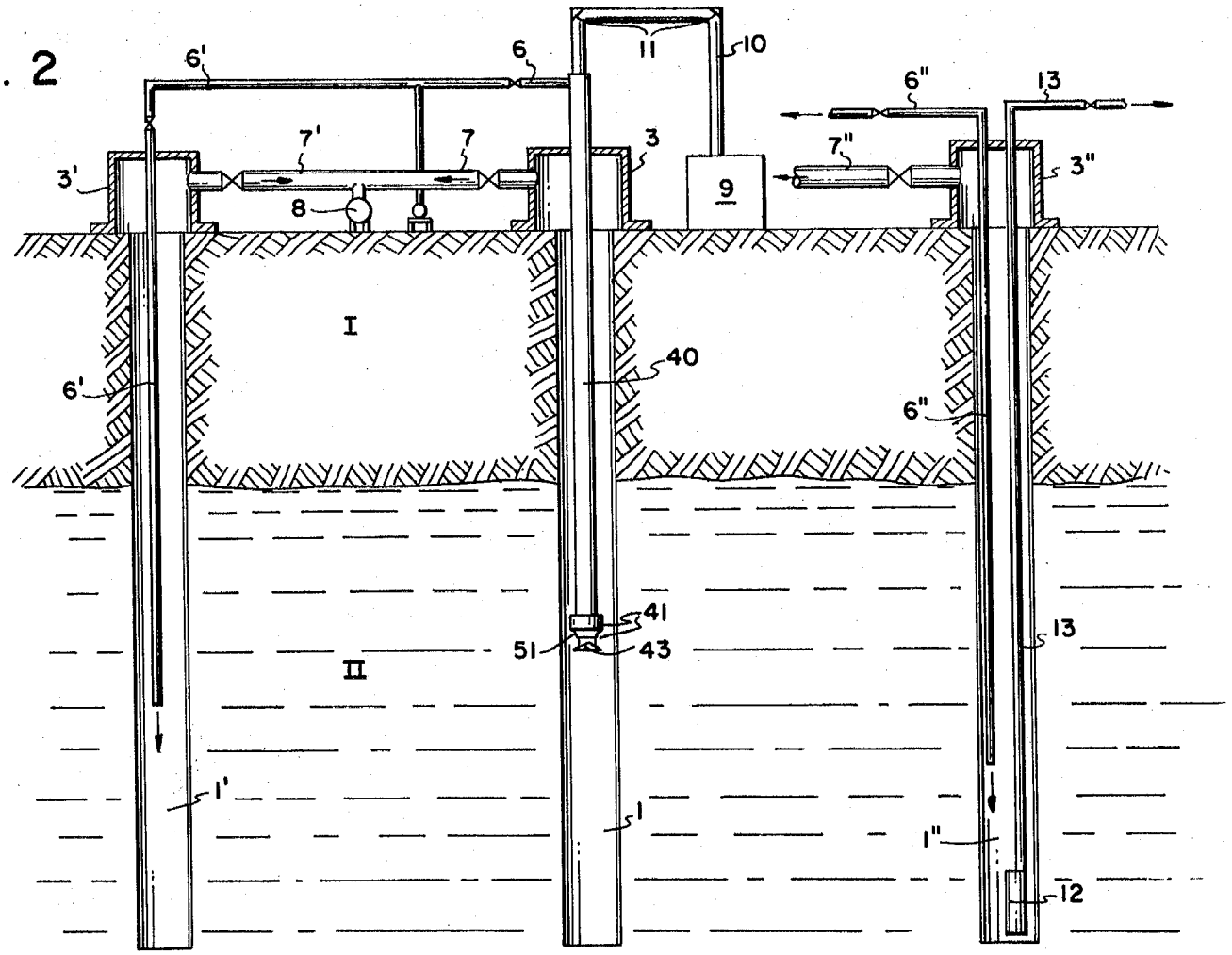

In the accompanying drawings which illustrate, by way of example, means for obtaining kerogen and gases from oil shale or tarsand, FIG. 1 is a vertical section through a borehole provided with equipment for irradiating its walls, for supplying air under pressure into the borehole and for extracting kerogen vapour and gas, and FIG. 2 is a section through a group of boreholes and the equipment required.

Referring to FIG. 1 of the drawings, a borehole 1 is drilled into the rock structure, comprising an upper layer of soil and rock I and a lower layer of oil shale II. The mouth of this borehole is closed by a tight fitting cover III which comprises a flange 31 attached to the soil around the borehole, a cylindrical body 32 and a top 33. A packing 34 is provided in an annular recess in the top which is retained by means of a gland 35. The packing serves to seal a vertical tube 40 in a duct provided in the top of the cover and to permit the tube's manual or mechanical shifting in the upward and downward direction. An exhaust pipe 36 is connected to the cylindrical body and leads to a storage vessel through a central pipe connecting several or all borehole covers.

The lower end of the tube 40 is provided with an annular block 41 the bottom surface of which forms an annular mirror 42 in the form of an inverted curved frustum. Below the annular mirror and at a short distance therefrom a conical mirror 43 is concentrically fastened to the block 41 by fastening means not shown in the drawing. The upper end of the tube is connected to a supply of air or oxygen under pressure through which the gas enters the bore, passes along the mirror assembly, and cools the mirror surfaces.

A hollow laser beam 5, which can be produced, for example, by an unstable optical resonator of known design, is directed into the upper opening of the tube 40 and guided concentrically therewith. The beam meets the conical surface of the mirror 43 which deflects it towards the annular mirror 42, from where it is again deflected towards the borehole walls, in the shape of a flat disc 51. The beam penetrates the shale and ignites the combustible matter contained therein. A part of this continues to burn with the aid of the oxygen or air blown into the bore through the tube 40, thereby raising the temperature of the entire rock structure around the bore. As a result of the heat the organic matter contained in the shale is converted to liquid oil and to gases at a temperature of between 300° and 700° C., the combustion process being controlled by regulating the air supply in order to keep the temperature within the desired limits. Since the oil is evaporated at so high a temperature, it rises, together with the gaseous fuel, to the top of the bore and escapes, or is pumped, through the pipe 36 to a container for further treatment and distillation.

The process of extracting fuel from oil shale has, in the foregoing, been described in respect of one borehole only, but it will be understood that it applies to a complete field of bores drilled at regular intervals in a pattern suitable for the specific shale area.

This is shown, by way of example, in FIG. 2, which diagrammatically illustrates a section through three boreholes 1, 1' and 1'', which represent a portion of an entire group of bores arranged around a central bore 1. As can be perceived from the drawing, only the central bore is provided with laser beam guiding equipment enclosed in, and attached to, a pipe 40 which also serves to convey air for cooling the mirror assembly 41, 43 by means of a supply pipe 6. The air, as mentioned in connection with FIG. 1, also serves to maintain the combustion process in the area surrounding the borehole. The borehole top is closed by a cylindrical cover 3 which contains the connections to the various pipes and is similar to the cover shown in FIG. 1. A gas-delivery discharge pipe 7 is connected to the side wall of the cover 3 and leads to a central gas discharge pipe 8. A laser beam generator 9 is positioned next to the borehole, and the generated beam is guided into the borehole by means of expandable tubing 10 provided with deflecting mirrors 11. The neighboring boreholes 1' and 1'' are similarly closed by covers 3' and 3'', from which gas pipes 7' and 7'' respectively lead to the central discharge pipe 8, but these boreholes are not provided with irradiating equipment. The latter is not necessary, since the combustion reaches these bores and the surrounding area by way of the cracks and fissures in the kerogen-bearing layer II. Bore 1' is, therefore, provided only with an air supply pipe 6', while bore 1'' is supplied with air through a pipe 6'' and, in addition, with a submersible pump 12, installed on or near the bottom of bore 1'', which serves to remove any groundwater seeping into the area from surrounding layers, and to pump it above ground through pipe 13.

It will be observed that the drawing is not made to true scale, in order to show the diameters of the boreholes and of the piping more clearly, and it is repeated that the bores 1' and 1'' are only two of a whole series of bores drilled around the central bore 1.

Compared with the aforementioned known methods the present method results in a higher yield per ton of shale at lower costs. While a high yield is attained by the first method described, viz. that comprising quarrying the rock and distilling the material above ground, the costs of quarrying and handling the enormous masses of rock make the process uneconomical. By the second method described, viz. that involving removal of the top soil overlying the kerogen-bearing formation, drilling holes, explosively loosening the shale, and igniting the top layer thereof, only a relatively small fraction of the kerogen content can be extracted, since all gaseous matter escapes into the air. The combustion process is not controlled and, accordingly, valuable fuel is liable to be burned instead of being extracted. The costs of removing the overlying rock layer and of its return after the field is exhausted are very high and raise the price of the obtained fuel to a multiple of that of imported crude oil.

With the present method removal and restauration of the top soil is obviated, and while calculations show that the cost of the energy required for operating the laser and air pumping equipment would be about the same as that of the earth moving process, the yield of kerogen is about three to four times that achieved with the conventional process.

In the foregoing only one kind of laser beam guide equipment has been illustrated and described, by way of example, viz. that involving the use of a hollow beam, but any other arrangement may be employed for irradiating the borehole walls. It is, for instance, proposed to use a solid beam obtained from a stable resonnator which can so be guided by means of a slowly rotating mirror moved in an axial direction, similarly to the set-up shown in FIG. 1, with cooling air passing through a central pipe 40. Such guidance will make the beam travel along the bore walls in a predetermined manner.

It is also proposed to ignite the organic matter by means of other heat sources such as, for instance, plasma guns, electric arc equipment, electron beam equipment or the like, and to maintain combustion by means of air or oxygen introduced into the borehole, but up to now the use of a laser beam has shown itself to be advantageous in respect of cost, controllability and cleanliness. The fact should, however, not be lost of sight that other heat sources, in combination with the laser or separately, may in the end be found to be better suited to the purpose in the course of the future development of the method even if, under present conditions, laser irradiation alone is still the best solution.

We claim:

1. A method of extracting kerogen and other combustible matter from oil shale comprising the following steps in combination, drilling at least one borehole from above, through the overlying soil and rock, into and through the oil shale layer, detonating an explosive charge inside the borehole, in order to loosen the rock structure and to increase its permeability, closing the mouth of said borehole by means of a tight cover provided with first duct means connected to gas or air pumping equipment means and with means adapted to permit a laser beam to be introduced into said borehole, and with second duct means connected to at least one gas and/or liquid storage vessel, guiding said laser beam through said first duct means into the borehole and irradiating the walls of said borehole along at least part of its length in the oil shale layer and causing the combustible matter in the shale to be ignited, introducing air or oxygen under pressure into said borehole through said first duct means in a quantity sufficient to keep the combustion going and to cool the laser beam guide equipment, and receiving and collecting combustion gases and evaporated kerogen in said gas storage vessel through said second duct means in said tight cover.

2. The method of extracting kerogen and other combustible matter, as defined in claim 1, comprising drilling a plurality of boreholes in an area of oilshale formation, providing each borehole with a tight cover adapted for connection of said borehole to a supply of air or oxygen under pressure and to a gas storage vessel respectively, connecting at last one laser beam source to one of said boreholes in turn, for the purpose of igniting the combustible matter in the specific borehole.

3. The method of extracting kerogen and other combustible matter as defined in claim 1, which comprises, in addition, measuring the properties and the quantity of the extracted gases as well as the temperature inside the borehole, and controlling this temperature by adjusting the intensity of said laser beam.

4. The method of extracting kerogen and other combustible matter as defined in claim 1, which comprises, in addition, measuring the properties and the quantity of the extracted gases as well as the temperature inside the borehole, and controlling this temperature by adjusting the supply of air or oxygen.

5. The method of extracting kerogen and other combustible matter as defined in claim 1, which comprises, in addition, measuring the properties and the quantity of the extracted gases as well as the temperature inside the borehole, and controlling this temperature by adjusting both the supply of air or oxygen and the intensity of said laser beam.

6. The method of extracting kerogen and other combustible matter as defined in claim 1, comprising introducing into said borehole said laser beam as well as air or oxygen under pressure, through the upper end of an air inlet tube slidingly and sealingly fastened in said tight cover on the mouth of said borehole, and moving said tube along the central longitudinal axis of the borehole in an upward and downward direction; causing said laser beam to be deflected toward the walls of said borehole by means of a mirror assembly firmly attached to the bottom end of said tube; and directing a stream of air or oxygen onto said mirror assembly to cool same.

7. The method of claim 6, comprising the provision of a tight cover to the borehole mouth, in the shape of a substantially cylindrical body, the bottom end of which is provided with a flange adapted for connecting said cover to said borehole mouth, the closed top of which is penetrated by said first duct in the shape of a sliding tube, and the side wall of which is penetrated by said second duct means in the shape of an exhaust pipe adapted for connection to a storage vessel.

8. The method of claim 6, comprising the provision of a mirror assembly in the shape of an annular block attached to the lower end of said inlet tube, the bottom surface of said block forming an annular mirror in the shape of an inverted curved frustum, and a conical mirror attached to said tube end, spaced apart from said annular mirror, the surface of said mirror assembly being formed so as to deflect a hollow laser beam passing through said tube towards the walls of said borehole, in the shape of a flat disc.

9. The method of claim 6, comprising introducing said laser beam into said borehole and guiding it towards the walls of said borehole through an optical lens system.

10. A method of extracting kerogen from tar sand comprising the following steps in combination, drilling at least one borehole from above, through the overlying soil and rock, into and through the tar sand layer, stabilizing the borehole walls to prevent collapse thereof, closing the top of said borehole by means of a tight cover provided with first duct means connected to gas or air pumping means and with means adapted to permit a laser beam to be introduced into said borehole, and with second duct means connected to at least one gas and/or liquid storage vessel, guiding said laser beam through said first duct means into said borehole and irradiating the walls of said borehole along at least part of its entire length in the tar sand layer and causing the combustible matter in the tar sand to be ignited, introducing air or oxygen under pressure into said borehole through said first duct means in a quantity sufficient to maintain the combustion and to cool the laser beam equipment, and receiving and collecting combustion gases and evaporated kerogen in said gas storage vessel through said second duct means in said tight cover.

11. A method as defined in claim 10, wherein said stabilizing of the borehole walls to prevent collapse thereof is effected by adding a solution of lime in water while the borehole is being drilled.

12. Apparatus for extracting kerogen from oil shale or tar sand located beneath an overlying layer of soil and rock, comprising tight cover means at the mouth of a borehole extending through the overlying soil and rock, into and through the oil shale or tar sand layer, said tight cover means being provided with first duct means and with second duct means; said first duct means comprising an air inlet tube slidingly and sealingly fastened in said tight cover means over the mouth of the borehole, said tube being movable along a central longitudinal axis of the borehole in an upwardly and downwardly direction, said tube being provided with a mirror assembly firmly attached at its bottom end thereof, said mirror being capable of deflecting a laser beam sideways, said tube being further provided with means for introducing into its upper end the laser beam and for guiding the laser beam to said mirror assembly;

means to supply oxygen or air under pressure to said tube to simultaneously effect cooling of said mirror assembly and air or oxygen under pressure to support combustion in the borehole; and means to remove kerogen from the borehole through said second duct means in said tight cover means, comprising at least one gas and/or liquid storage vessel downstream from said second dust means.

13. Apparatus as defined in claim 12, in which said tight cover is in the shape of a substantially cylindrical hollow body, the bottom end of which is provided with a flange for connecting said cover to a borehole mouth, the closed top of which is penetrated by said first duct adapted for the passage of said air inlet tube, and the side wall of which is penetrated by said second duct.

14. Apparatus as defined in claim 12, wherein said mirror assembly comprises an annular block attached to the lower end of said air inlet tube, the bottom surface of said block forming an annular mirror in the shape of an inverted curved frustum, and a conical mirror attached to said tube end, spaced-apart from said annular mirror, the surfaces of said mirror assembly being formed so as to deflect a hollow laser beam passing through said air inlet tube towards the walls of said borehole in the shape of a flat disc.

* * * * *